US007791548B2

(12) United States Patent
Oshima et al.

(10) Patent No.: US 7,791,548 B2
(45) Date of Patent: Sep. 7, 2010

(54) ON-BOARD ANTENNA DEVICE

(75) Inventors: Hideaki Oshima, Tokyo (JP); Hiroshi Iijima, Tokyo (JP); Satoru Komatsu, Tokyo (JP); Hiroshi Kuribayashi, Saitama (JP); Masashi Nakagawa, Tokyo (JP); Norio Tanaka, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 606 days.

(21) Appl. No.: 11/755,160

(22) Filed: May 30, 2007

(65) Prior Publication Data

US 2007/0279305 A1 Dec. 6, 2007

(30) Foreign Application Priority Data

May 30, 2006 (JP) ..... 2006-149325

(51) Int. Cl.
*H01Q 1/32* (2006.01)
*H01Q 1/38* (2006.01)
*H01Q 1/50* (2006.01)

(52) U.S. Cl. ..... 343/713; 343/700 MS; 343/906

(58) Field of Classification Search ..... 343/711, 343/713, 700 MS, 841, 905, 906
See application file for complete search history.

(56) References Cited

U.S. PATENT DOCUMENTS 6,522,291 B1 2/2003 Noguchi et al.
7,576,700 B2 * 8/2009 Oshima et al. ..... 343/713
2005/0285805 A1 * 12/2005 Ikeda et al. ..... 343/713
2005/0285806 A1 * 12/2005 Ikeda et al. ..... 343/713
2006/0109178 A1 * 5/2006 Takeuchi et al. ..... 343/700 MS

FOREIGN PATENT DOCUMENTS

EP 1 517 403 A2 3/2005
JP 2006013959 1/2006

OTHER PUBLICATIONS

EP Search Report Jul. 31, 2007.

* cited by examiner

*Primary Examiner*—Shih-Chao Chen
(74) *Attorney, Agent, or Firm*—RatnerPrestia

(57) ABSTRACT

An on-board antenna device comprises: a radiation element (302) formed on an inner-surface of a widow glass (51) for a vehicle (50); a base plate (305) fixed on the inner-surface of the widow glass (51) so as to surround the radiation element (302); a circuit board (308) having a conductive layer in a surface (308*a*) thereof, which is opposed to the radiation element (302), and a component mounting surface electrically connected to the radiation element (302) in the other surface (308*b*) thereof; and a housing (312) assembled onto the base plate (305), and the circuit board (308) being contained therein; wherein the circuit board (308) has a cutout portion (308*f*) to incorporate a connector (324) for a transmission line connection.

4 Claims, 14 Drawing Sheets

ON-BOARD ANTENNA DEVICE

TECHNICAL FIELD

The present invention relates to an on-board antenna device, particularly to an on-board antenna device formed on a widow glass for a vehicle, where an optimized structure of an electronic circuit unit is provided for the on-board antenna device so as to become loss-less of the radiation energy gain to implement good productivity and the miniaturization thereof.

RELATED ART

Conventionally, an on-board antenna device for a vehicle is known, in which the on-board antenna device enables to receive circularly-polarized wave or linearly-polarized wave transmitted from a satellite or an ground station by forming a radiation element on a inner-surface of a widow glass, for example a rear glass, in a vehicle interior and arranging an electronic circuit unit on the inner-surface, the electronic circuit unit including a pre-amplifier. This type of an on-board antenna device has an advantageous effect, for example long-life of the on-board antenna device and lower risk of the theft of the on-board antenna device, compared with an on-board antenna device formed on an outside of a vehicle, such as a roof thereof. Moreover, the type of the on-board antenna device has an advantageous effect of a widely viewing angle for a driver of the vehicle, compared with an antenna arrangement placed in the adjacent location of the widow glass in the vehicle interior.

In the type of the on-board antenna device, it is composed so that the electronic circuit unit formed on inner-surface of the widow glass, for example the rear glass or a front glass, in the vehicle interior may contain a circuit board including a pre-amplifier, etc. in a housing of the electronic circuit unit. Moreover, the radiation element, having a predefined shape, formed on the widow glass may be electrically connected to the circuit board through a feeder cable etc. for feeding to the radiation element and receiving an incoming signal.

The example of the prior art is now described referring to drawings. Each of FIGS. 16A and 16B is a plan view showing the fixing location of an antenna unit for a vehicle. FIG. 16A is a side view of a vehicle, and FIG. 16B is a plan view of a rear glass observed from a vehicle interior.

As shown in is FIGS. 16A and 16B, the antenna unit for the vehicle is composed of a set of an on-board antenna device 100 for an ground station and an on-board antenna device 200 for a satellite which are formed on the inner-surface of the rear glass 51 for the vehicle 50. The electromagnetic radiation of linearly-polarized wave (vertically-polarized wave) transmitted from the ground station may be received by the on-board antenna device 100 for the ground station, and the electromagnetic radiation of circularly-polarized wave transmitted from the satellite may be received by the on-board antenna device 200 for the satellite. This antenna unit may obtain good sensitivity of several electromagnetic radiations by interactively operating the on-board antenna device 100 and the on-board antenna device 200.

The on-board antenna device 200 for the satellite is now described. The on-board antenna device 200 provided with an antenna unit for a vehicle is shown in FIGS. 17-19. FIG. 17 is perspective view showing an electronic circuit unit of the on-board antenna device for the satellite. FIG. 18 is a plan view showing the arrangement of the on-board antenna device 200 constructed by a base plate of the electronic circuit unit and the radiation element formed on a widow glass. FIG. 19 is exploded perspective view of the electronic circuit unit. The on-board antenna device 200 is provided for a patch antenna. The on-board antenna device 200 is mainly composed of an electronic circuit unit 21 formed on the inner-surface of the rear glass 51 in the vehicle interior and a radiation element 22 formed on the inner-surface of the rear glass 51. The electronic circuit unit 21 comprises: a base plate 24 fixed on the inner-surface of the rear glass 51; a circuit board 26 electrically connected to the radiation element 22 and a ground element 23 through a coaxial cable, such as a feeder cable 25; a housing 27 assembled onto the base plate 24 to contain the circuit board 26; a connector cover 32; an output cable 28 (for example, a coaxial cable) in which one end of the output cable 28 is connected to the circuit board 26 while the other end thereof is connected to an external receiver (not shown); and a DC cable 9 for supplying power to a antenna device 100 for a ground station.

In that case, the housing 27 is composed of a square-shaped frame 30 and a cover 31.

The construction of each part of the on-board antenna device 200 for the satellite is described in detail. As shown in FIG. 18, the radiation element 22, which is a patch electrode formed in the substantial square-shape, includes notched-shaped isolation elements 22*a* for degeneration formed on both corners in a direction of one diagonal line. The ground element 23, which is a ground electrode formed in the substantial square-shape, surrounds keeping a predetermined space to the radiation element 22. Both of the radiation element 22 and the ground element 23 are conductive layers made of good conductive metal, such as Ag. As shown in FIG. 18, the feeding point of the radiation element 22 is connected to an internal conductor of a feeder cable 25. Moreover, the ground element 23 is connected to an external conductor of the feeder cable 25.

The base plate 24 has a square-shape surrounding an opening 24*a*, on which a plurality of female screws 24*b* are mounted. The frame 30 is fixed to the base plate 24 by clamping each male screw 33 to each of the plurality of female screws 24*b* through each hole of outwardly protruded portions 30*a* of the frame 30. As shown in FIG. 18, the base plate 24 is fixed to the widow glass 51 with a humidity-hardening resin 34.

As shown in FIG. 19, the square-shaped frame 30 mainly comprises a pair of opposing sidewalls 30*b* and 30*c* and a pair of opposing sidewalls 30*d* and 30*e*. Outwardly protruded portions 30*a* are designed in both longitudinal-direction-sides of each of the sidewalls 30*b* and 30*c*, respectively. The end of the frame 30, opposing to the rear glass 51, has fitting portions 30*f* to be loosely inserted into the opening 24*a* of the base plate 24. The stoppers 30*g* formed respectively in near each corner of the fitting portions 30*f* are hit to the base plate 24. In this manner, each depth of the fitting portions 30*f* to be inserted into the opening 24*a* is set to be lower than the thickness of the base plate 24. The stopper 30*g* are formed in both longitudinal-direction-sides of the sidewalls 30*b* and 30*c*, respectively, and are protruded at a small amount with respect to the adjacent sidewalls 30*d* and 30*e*. A plurality of small holes 30*h* are designed in adjacent regions of edge portions of the frame 30, in the side opposed to the fitting portions 30*f*.

Each of sidewalls 30*b*-30*e* of the frame 30 comprises tongues 30*j* bent toward the inner-space and through-holes 30*k* formed for the tongues 30*j*, and the circuit board 26 is supported by the tongues 30*j*. In addition, the through-holes 30*k* provided in sidewalls 30*b* function as a hole for pulling out water.

As shown in FIG. 19, one surface of the circuit board 26 is a component mounting surface 26*a* on which various electronic components (not shown) including an amplifier are mounted. One end of the feeder cable 25 is connected to the component mounting surface 26*a* through a pair of connectors 36 and 37, while the other end of the feeder cable 25 is connected to the radiation element 22 and the ground element 23 both. That is, the one end of the feeder cable 25 is connected to the input of the pre-amplifier.

Moreover, one end of each of the coaxial cable 28 and the DC cable 9 are soldered to the component mounting surface 26*a*, and the other end of each of these cables are provided with a connector 38. A plurality of surrounding edge portions of the component mounting surface 26*a* are soldered to the frame 30. Thereby, the frame 30 function as a ground electrically, and the circuit board 26 and the frame 30 are mechanically coupled. The other surface (the reverse surface) of the circuit board 26, i.e. a opposite surface thereof to the radiation element 22 and the ground element 23, is an electromagnetic wave reflecting surface 26*b* on which a conductive layer consisting of a good conductive metal, such as Au, is formed. The surrounding edge portion of the electromagnetic wave reflecting surface 26*b* is supported by means of tongues 30*j* in a plurality of portions of the frame 30.

Such on-board antenna device 200 for a satellite is disclosed as a prior art, for example, in Japanese Patent Application Laid-Open No. 2006-13959.

DISCLOSURE OF THE INVENTION

In such conventional on-board antenna device, the conventional on-board antenna device has such a structure that an output cable to connect to an external receiver (not shown) and a DC output cable to apply power are soldered to a circuit board 6. The purpose of the conventional on-board antenna device having such structure is to make the height of an electronic circuit unit thinner, and to provide for a good usability assembled easily. In other words, the on-board antenna device must be prevented not to be larger so as to fulfill more suitable providing-requirements of an on-board antenna device.

However, such a soldering structure of the electronic circuit unit increase the cost of the soldering process and the cost of quality management of the soldered electronic circuit board, and thereby the manufacturing cost of the on-board antenna device may be increased.

In addition, since the height (i.e. thickness) of the electronic circuit unit becomes higher by mounting a connector for the output cable onto a circuit board, on which the connector is mounted for the transmission line connection instead of the soldering process of the output cable, it may be a result in contradiction to the subject that provides an on-board antenna device with an good usability.

The subject matter of the present invention is to solve the above problem, and to provide an on-board antenna device with more low-cost or more high-quality.

An on-board antenna device in accordance with the present invention is provided, which comprises: a radiation element formed on an inner-surface of a widow glass for a vehicle; a base plate fixed on the inner-surface of the widow glass so as to surround the radiation element; a circuit board having a conductive layer in a surface thereof which is opposed to the radiation element and a component mounting surface electrically connected to the radiation element in the other surface thereof; and a housing assembled onto the base plate to contain the circuit board; wherein the circuit board has a cutout portion to incorporate a connector for a transmission line connection.

Another aspect of an on-board antenna device in accordance with the present invention is provided, which comprises: a radiation element formed on an inner-surface of a widow glass for a vehicle; a base plate having an opening, the base plate being fixed on the inner-surface of the widow glass so as to surround the radiation element; a feeding board arranged a feeding pattern on one surface thereof, the feeding pattern being opposed with a predetermined distance to the radiation element; a circuit board including a conductive layer formed across the substantial entire area of one surface thereof which is opposed to the feeding board and a pre-amplifier mounted on the other surface thereof; a small connection board arranged between the feeding board and the circuit board in a vertical direction to the feeding board and the circuit board; and a housing assembled onto the base plate to contain the feeding board, the circuit board and the small connection board in a space surrounded thereby; wherein the on-board antenna device is indirect-feed by electro-magnetically coupling a feeding pattern to the radiation element and the circuit board has a cutout portion to incorporate a connector for a transmission line connection.

By providing the circuit board including the pre-amplifier with the hollow-shaped cutout portion based on the method for defining the size of the cutout portion in accordance with the present invention, the on-board antenna device may be provided with an improved structure in which the connector for the transmission line connection is arranged into the electronic circuit unit without sacrificing the height of the on-board antenna device and without providing the loss of the antenna performance, and the manufacturing cost of the on-board antenna device may be decreased.

BEST MODE FOR CARRYING OUT THE INVENTION

First of all, the problem of the prior art is now described to facilitate understanding of the feature of the present invention.

Figure 5A:
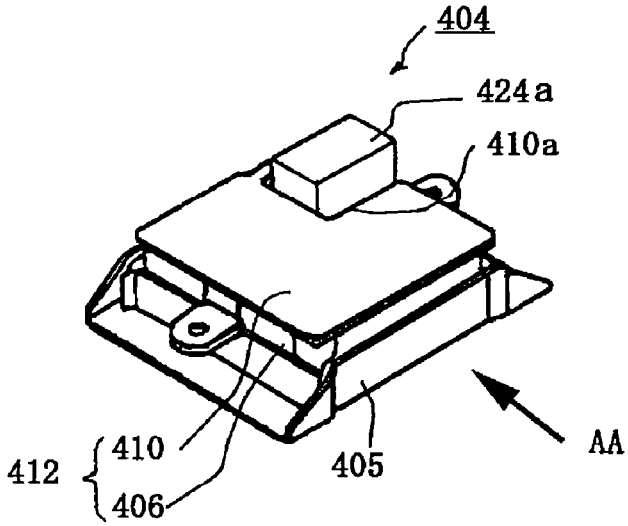
FIG. 5A is a perspective view showing an on-board antenna device in which a connector for transmission line connection is normally arranged.
Figure 5B:
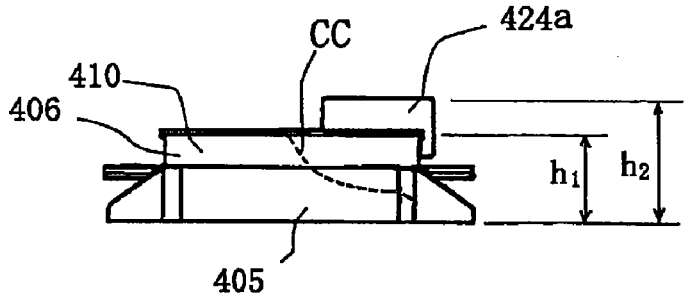
FIG. 5B is a side view showing an on-board antenna device observed from the direction indicated by an arrow AA in FIG. 5A.
Figure 5C:
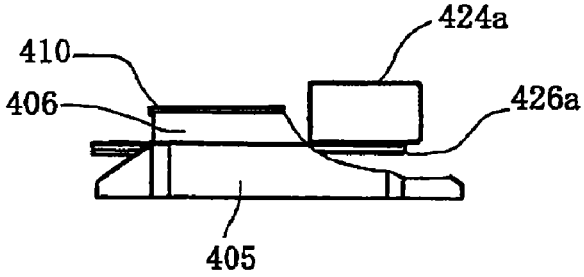
FIG. 5C is a partial cross sectional view showing an on-board antenna device in which a connector for transmission line connection is normally arranged.

In FIG. 5A, an on-board antenna device in the prior art is schematically illustrated. FIG. 5A is a perspective view showing an on-board antenna device in which a connector for transmission line connection is normally arranged. FIG. 5B is a side view showing an on-board antenna device observed from the direction indicated by an arrow AA in FIG. 5A. FIG. 5C is a partial cross sectional view showing an on-board antenna device in which a connector for transmission line connection is normally arranged.

Figure 18:
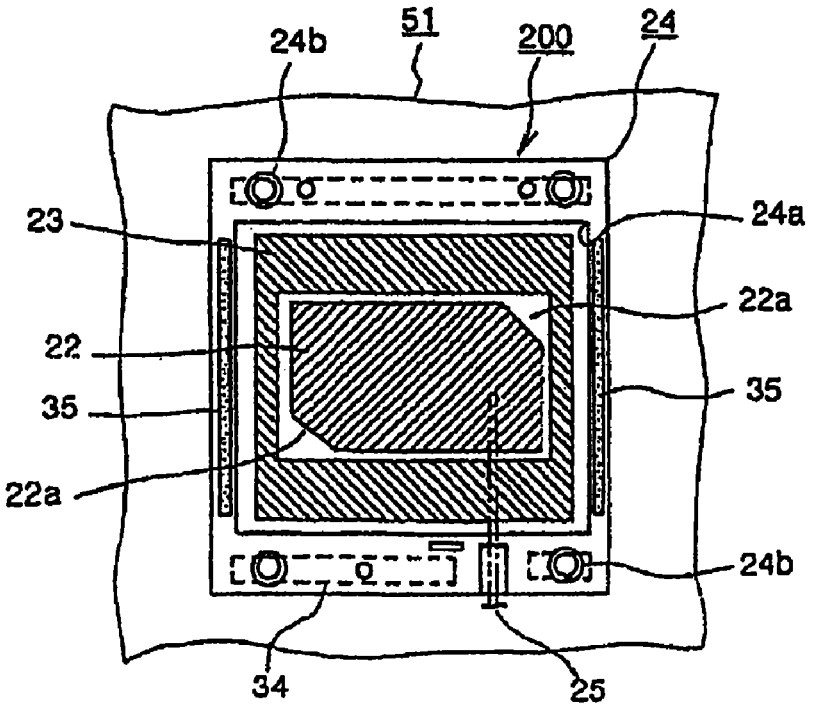
FIG. 18 PRIOR ART
FIG. 18 is a plan view showing location of a base plate and a radiation element in an electronic circuit unit of the prior art.
Figure 19:
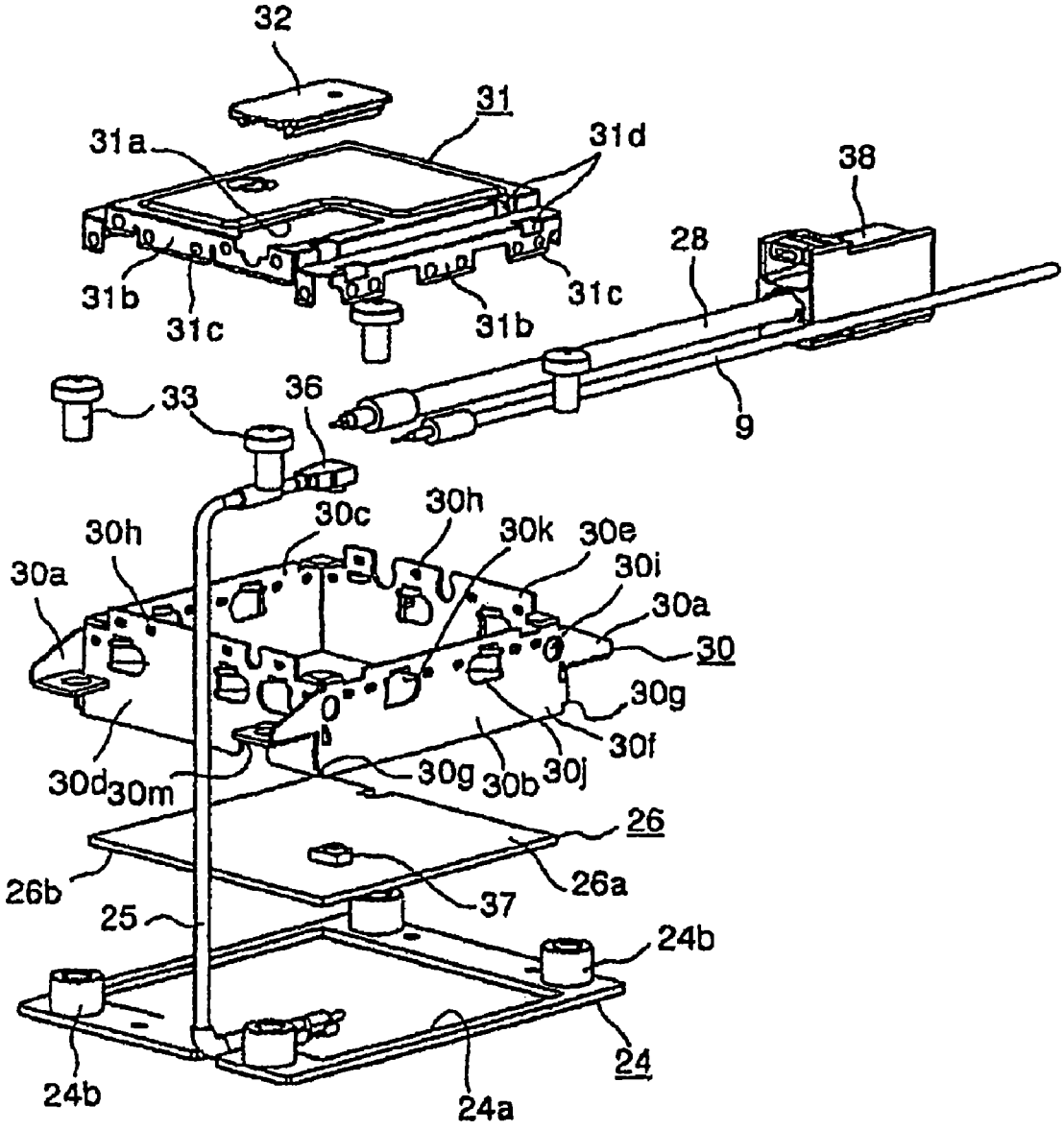
FIG. 19 PRIOR ART
FIG. 19 is an exploded perspective view of an electronic circuit unit in the prior art.

For example, the construction (indicated as 404) shown in FIG. 5A may be considered as the on-board antenna device shown in FIG. 19, in order to reduce the soldering process of an output cable 28, which is a problem to be solved in the prior art. That is, a connector 424*a* for transmission line connection may be used instead of the connection by the soldering process of the output cable 28. For example, such connector for transmission line connection includes a connector for an output cable. It is now described that a connector 424*a* for transmission line connection is arranged into a circuit board 426*a* (which, for example, corresponds to the circuit board 26 shown in FIG. 19) and that a cover 410*a* provided on a housing 412 has a cover-opening 410*a* so as to avoid covering the upper-surface of the connector for transmission line connection. A metallic frame 406 and a metallic base plate 405 are illustrated as different with the structure shown in FIGS. 17-19, but these may be implemented as identical structure with the frame 30 and the base plate 24 shown in FIG. 19, respectively. Alternatively, the frame and the base plate may be made from non-metallic materials, such as a resin or a glass, with electrical conductive coating coated on the surfaces thereof or with metallic micro-particles contained into the non-metallic materials. The structures of the frame and the base plate are not subject matters of the present invention.

Figure 17:
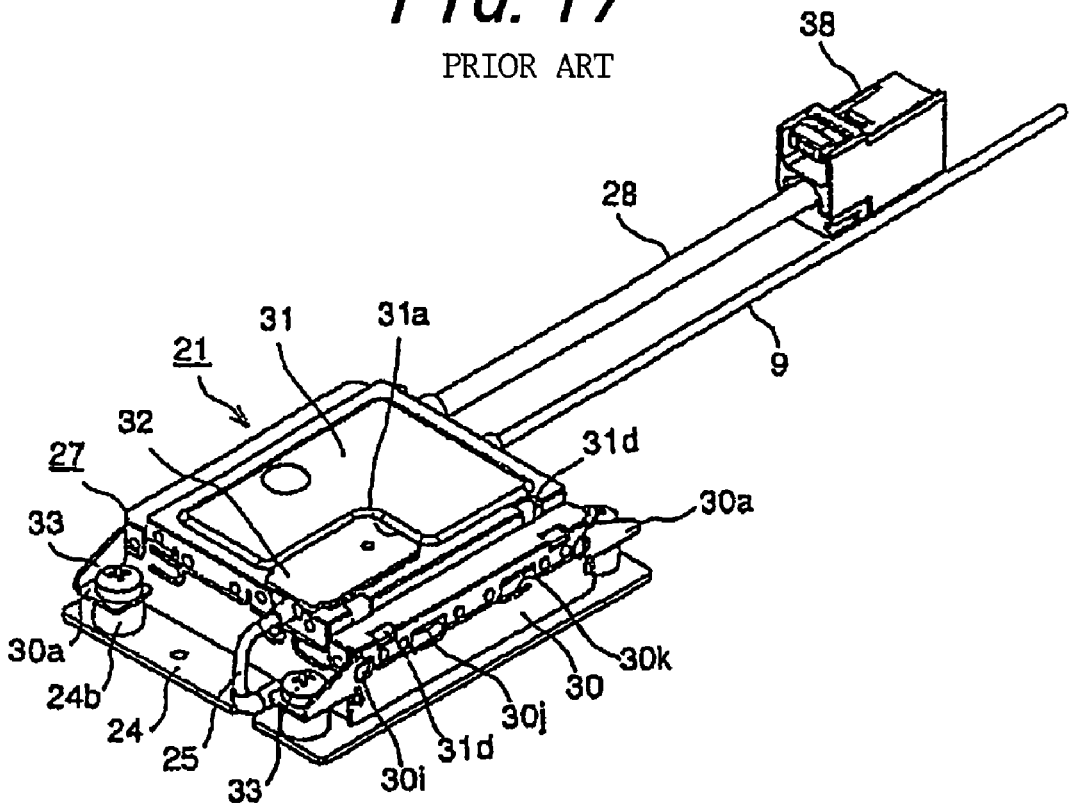
FIG. 17 PRIOR ART
FIG. 17 is a perspective view showing an electronic circuit unit of antenna device for a satellite in the prior art.

As shown in FIGS. 5B and 5C, the height h2 of an on-board antenna device including the connector for transmission line connection will be higher than the height h1 of the conventional on-board antenna device (as shown in FIGS. 17-19), because the connector 424*a* is mounted on the circuit board 426*a*. This means providing for a larger on-board antenna device relative to the conventional on-board antenna device.

While the manufacturing process, such as the soldering process of the output cable, may be omitted in the on-board antenna device as shown in FIG. 5, it is undesirable for an on-board antenna device to become large.

Then, an on-board antenna device in accordance with an embodiment of the present invention is now described.

A First Embodiment

Figure 6A:
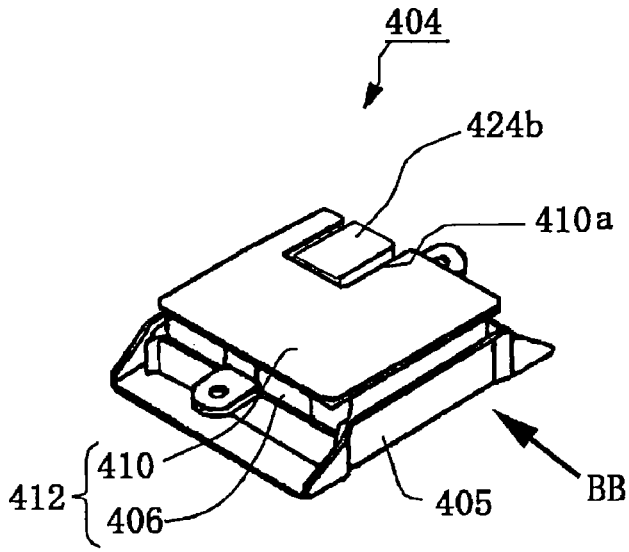
FIG. 6A is a perspective view showing an on-board antenna device in which a connector for transmission line connection is arranged in accordance with the present invention.
Figure 6B:
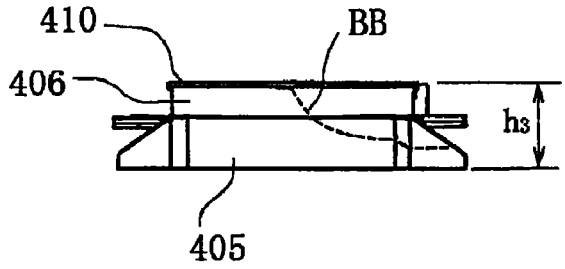
FIG. 6B is a side view showing an on-board antenna device in which a connector for transmission line connection is arranged in accordance with the present invention.
Figure 6C:
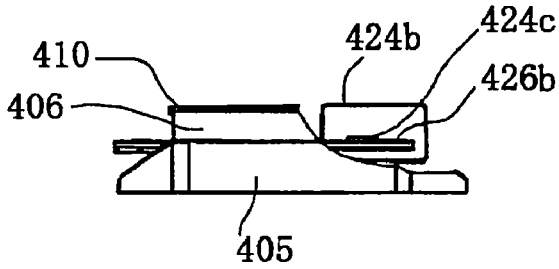
FIG. 6C is a partial cross sectional view showing an on-board antenna device in which a connector for transmission line connection is arranged in accordance with the present invention.

FIG. 6A is a perspective view showing an on-board antenna device in which a connector for transmission line connection is arranged in accordance with the present invention. FIG. 6B is a side view showing an on-board antenna device in which a connector for transmission line connection is arranged in accordance with the present invention. FIG. 6C is a partial cross sectional view showing an on-board antenna device in which a connector for transmission line connection is arranged in accordance with the present invention. In FIGS. 6A-6C, the same numerals are fixed to similar components or elements with respect to FIGS. 5A-5C.

As shown in FIGS. 6A-6C, an on-board antenna device has a structure in which a hollow-shaped cutout portion is designed into a circuit board 426*b*, on which a connector 424*b* for transmission line connection is arranged, based on the method for defining the size of the cutout portion, as described later, to incorporate the connector 424*b* in the circuit board 426*b*. Therefore, the connector 424*b* is inserted into the cutout portion of the circuit board 426*b* to be incorporated therein. That is, terminal pins 424*c* is formed on the lateral of the connector 424*b* to enable electrical connection to the circuit board 426*b*. In addition, a housing has a cover opening that is larger than an area of the upper-surface of the connector 424*b* in the upper-surface of the housing, so that the connector 424*b* arranged into the circuit board 426*b* prevents coming in contact with the housing. When the connector 424*b* may be inserted into the cutout portion of the circuit board

426*b* at lower location for the cover 410 enough with respect to the height of the connector 424*b*, the cover opening need not be formed. Providing an on-board antenna device with the structure, shown in FIGS. 6A-6C, in which the connector 424*b* is inserted into the hollow-shaped cutout portion of the circuit board 426*b*, the manufacturing process such as the soldering process of the output cable may be omitted and the height of the on-board antenna device may be lower up to a desired height thereof (indicated as $h_3$).

However, providing the circuit board 426*b* with the hollow-shaped cutout portion (e.g. the circuit board 26 shown in FIG. 19) means cutting an electromagnetic wave reflecting surface (for example, the electromagnetic wave reflecting surface corresponds to the electromagnetic wave reflecting surface 26*b* shown in FIG. 19, which is formed by conductive layers made of good conductive metal, such as Au) of the circuit board 426*b*, the electromagnetic wave reflecting surface being one surface of the circuit board 426*b* in a widow glass side thereof, as the result it is expected that an enough antenna performance may not be maintained, even if the structure, shown in FIGS. 6A-6C, is provided. Therefore, the hollow-shaped cutout portion of the circuit board 426*b* should be designed on the basis of a peripheral method for defining the size thereof.

Then, it is described that a method for defining the hollow-shaped cutout portion is designed into the circuit board 426*b* in accordance with the present invention.

Figure 1A:
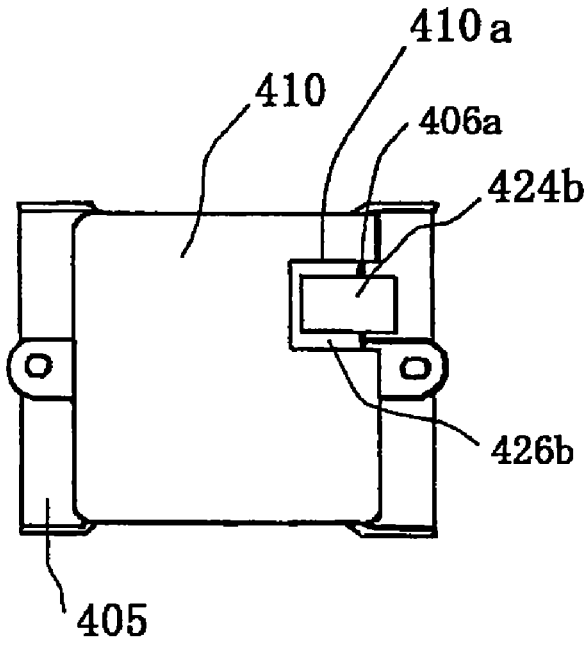
FIG. 1A is a plan view of an on-board antenna device for a vehicle in accordance with an embodiment of the present invention.
Figure 1B:
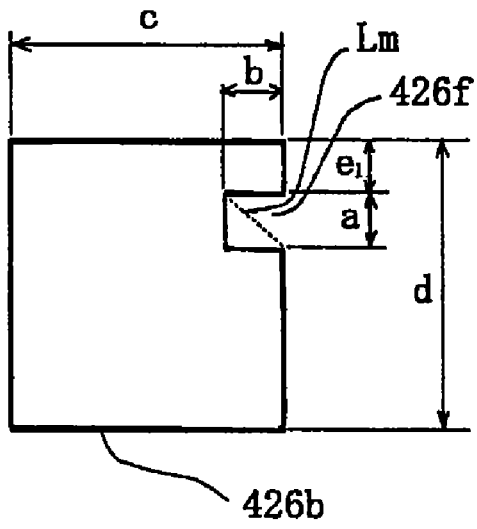
FIG. 1B is a plan view of a circuit board provided for an on-board antenna device for a vehicle in accordance with an embodiment of the present invention.

FIG. 1A is a plan view of an on-board antenna device for a vehicle, which is shown in FIG. 6A, in accordance with an embodiment of the present invention. FIG. 1B is a plan view of a circuit board 426*b* provided for an on-board antenna device, which is shown in FIG. 1A, in accordance with an embodiment of the present invention. In FIGS. 1A and 1B, the same numerals are fixed to similar components or elements with respect to FIGS. 6A-6C. In FIG. 1A, a cover opening 410*a* is designed into a cover 410 to suitably compose a connector 424*b* for transmission line connection. The circuit board 426*b* having a cutout portion 426*f* is shown in FIG. 1B, and the outward form of the circuit board 426*b* is indicated with side c and length d therein. Moreover, the outward form of the cutout portion 426*f* is indicated with side b and length a therein, and the maximum dimension Lm of the cutout portion 426*f* is also indicated. The maximum dimension Lm is defined by maximum length of the shape of the cutout portion in consideration of a radiation energy wavelength. According to maximum dimension Lm of a cutout portion, for example, the maximum dimension Lm is the diagonal diameter of the cutout portion 426*f* in FIG. 1B, because the diagonal diameter is maximum length of the shape. As will be understood, such shape of the cutout portion may be circular-shape, elliptical-shape, or polygonal-shape and is defined by the maximum dimension of the cutout portion (i.e. the diameter in case of circular-shape, the major axis in case of elliptical-shape or the maximum diagonal length in case of polygonal-shape), hereinafter referred to as "maximum dimension of a cutout portion". While a dimension $e_1$, which defines the location of the cutout portion 426*f*, is shown in FIG. 1B, the advantageous effect of the cutout portion designed based on the method for defining the hollow-shaped cutout portion in accordance with the present invention may not be influenced even if the dimension $e_1$ has any values, as described later.

The "maximum dimension of a cutout portion" designed into the circuit board 426*b* is defined with respect to a wavelength of a receiving frequency band of an on-board antenna device as described below.

The side c and length d of a circuit board is shorter than a wavelength of a receiving frequency band of an on-board antenna device and is longer than ⅕ of the wavelength, and the maximum dimension of a cutout portion designed into the circuit board is defined by 20% or less of the wavelength. Suitably, the maximum dimension is defined by 10% or less of the wavelength.

Reasons to define the maximum dimension Lm of the cutout portion 426*f* provided for the circuit board 426*b* is now described.

Figure 2A:
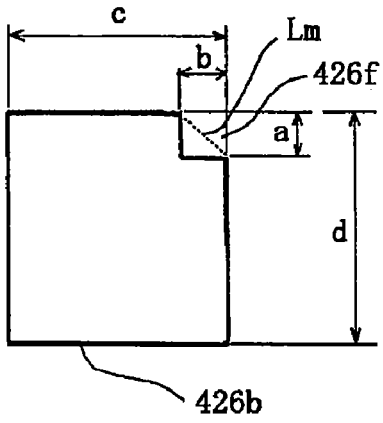
FIG. 2A is a plan view showing a circuit board in which a cutout portion is arranged in the corner of the circuit board in accordance with an embodiment of the present invention.
Figure 2B:
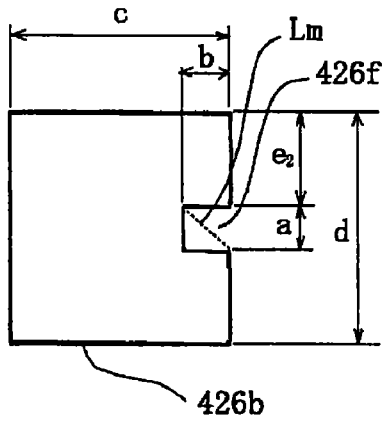
FIG. 2B is a plan view showing a circuit board in which a cutout portion is arranged in the middle edge of the circuit board in accordance with an embodiment of the present invention.
Figure 2C:
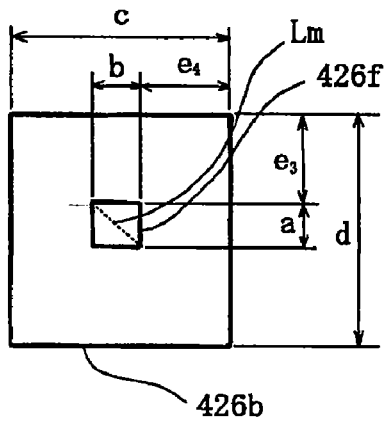
FIG. 2C is a plan view showing a circuit board in which a cutout portion is arranged in the center of the circuit board in accordance with an embodiment of the present invention.

Arrangements of the cutout portion 426*f* designed into the circuit board 426*b* on the basis of the on-board antenna device shown in FIGS. 1A and 1B are schematically shown in FIGS. 2A-2C, respectively. FIG. 2A is a plan view showing a circuit board in which a cutout portion 426*f* is arranged in the corner of the circuit board 426*b* in accordance with an embodiment of the present invention. FIG. 2B is a plan view showing a circuit board in which a cutout portion 426*f* is arranged in the middle edge of the circuit board 426*b* in accordance with an embodiment of the present invention (as defined by the indicated dimension $e_2$). FIG. 2C is a plan view showing a circuit board in which a cutout portion 426*f* is arranged in the center of the circuit board 426*b* in accordance with an embodiment of the present invention (as defined by the indicated dimensions $e_3$ and $e_4$). In FIGS. 2A-2C, the same numerals are fixed to similar components or elements with respect to FIGS. 1A and 1B. The cutout portion may be designed with any position into the circuit board, and a suitable antenna performance may be obtained in any case of FIGS. 2A-2C on the basis of the method for defining the cutout portion 426*f* according to the present invention, as described later.

Figure 3:
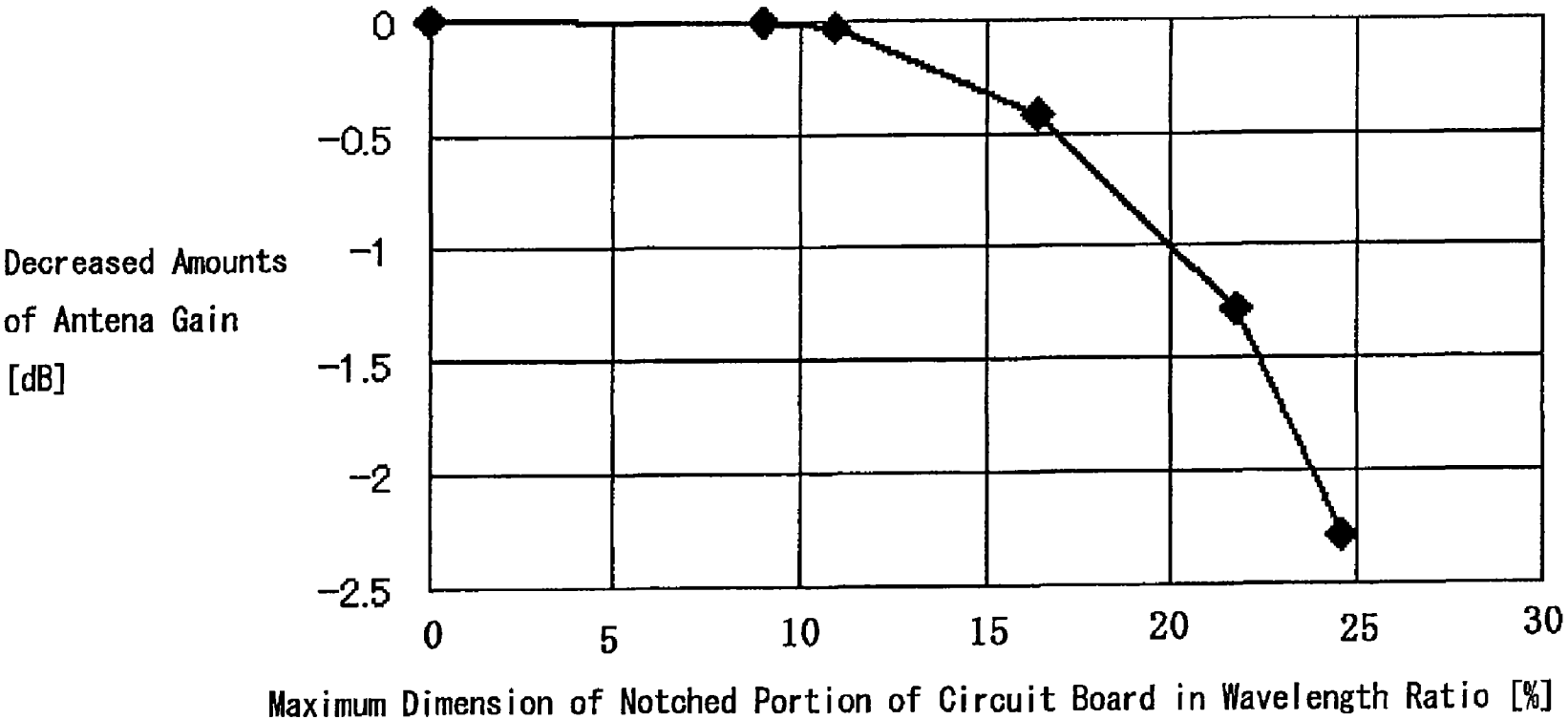
FIG. 3 is a characteristic chart showing relation between the maximum dimension of a cutout portion and the decreased amount of an antenna gain variation, in accordance with an embodiment of the present invention.

FIG. 3 is a characteristic chart showing the decreased amount of the antenna gain, in which the maximum dimension of a cutout portion of a circuit board is changed. The decreased amount of the antenna gain is shown in FIG. 3, in which the maximum dimension of a cutout portion of the circuit board is changed from 0 to about 25%, in a ratio to a wavelength of a receiving frequency band of an on-board antenna device (referred to as the wavelength ratio), where the side c and the length d of the circuit board are ⅓.5 of the wavelength. The variation of the antenna gain is a relative variation of the average gain value in the elevation-angle 20 deg section of Left Handed Circularly polarized (LHC) wave and is normalized as 0 dB at the condition of lack of the cutout portion (i.e., in which the cutout portion is not arranged into the circuit board). It is understood in FIG. 3 that the antenna gain becomes more decreased as the maximum dimension of the cutout portion becomes longer. In addition, as the variation of the antenna gain is generally acceptable for 1 dB, the maximum dimension of the cutout portion should be at least 20% or less of the wavelength. Thereby, it is preferable that the maximum dimension of the cutout portion is 10% or less of the wavelength to fulfill the requirement of the antenna performance.

Then, reasons why a cutout portion may be designed with any position into the circuit board on the basis of the method for defining the cutout portion according to the present invention are described.

Figure 4:
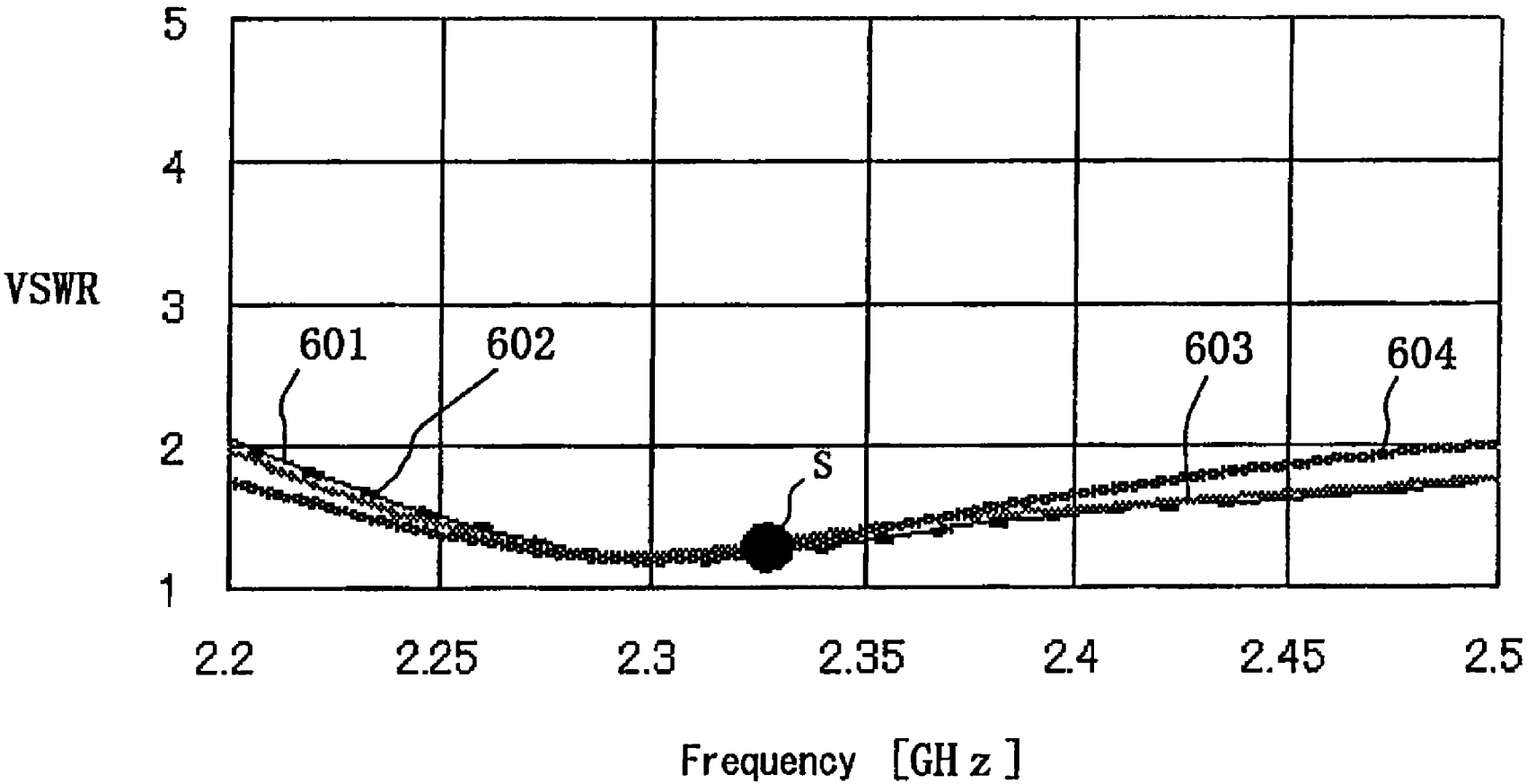
FIG. 4 is a characteristic chart showing relation between frequency and the voltage-standing-wave ratio (VSWR), in accordance with an embodiment of the present invention.

FIG. 4 is a simulation result with regard to a characteristic chart showing relation between frequency and the voltage-standing-wave ratio (VSWR), wherein the side c and the length d of a circuit board are ⅓.5 of the wavelength and the maximum dimension of a cutout portion of the circuit board is 7.5% as the wavelength ratio. The simulation result, which is shown in FIG. 4, is now described in reference to FIGS. 2A-2C. In FIG. 4, a characteristic value indicated with a solid line (indicated as 601) is a characteristic value of an on-board antenna device, in which a cutout portion is not designed into a circuit board and may be considered as an ideal value. In addition, a characteristic value indicated with a dot line (indicated as 602) is a characteristic value of an on-board antenna device, in which a cutout portion, which corresponds to the structure shown in FIG. 2A, is arranged in the corner of a circuit board. Moreover, a characteristic value indicated with a light gray of a stitch line (indicated as 603) is a characteristic value of an on-board antenna device, in which a cutout portion, which corresponds to the structure shown in FIG. 2B, is arranged in the middle edge of a circuit board. In addition, a characteristic value indicated with a deep gray of a stitch line (indicated as 604) is a characteristic value of an on-board antenna device, in which a cutout portion, which corresponds to the structure shown in FIG. 2C, is arranged in the center of a circuit board. It is understood in FIG. 4 that stable results of antenna gain may be obtained regardless of existence or non-existence of the cutout portion in any position thereof.

Then, an indirect-feeding type of an on-board antenna device for a vehicle in accordance with an embodiment of the present invention is described.

A Second Embodiment

An indirect-feeding type of an on-board antenna device differs from the conventional on-board antenna device for a vehicle (FIGS. 17-19), and the on-board antenna device does not need to comprise the feeder cable (shown as the feeder cable 25 in FIG. 19). Hereinafter, the conventional on-board antenna device is referred to as a direct-feed type of an on-board antenna device, and is distinguished from the indirect-feeding type.

In this embodiment, the on-board antenna device is provided on the basis of a method for defining a cutout portion as follows.

The side c and length d of a circuit board is shorter than a wavelength of a receiving frequency band of an on-board antenna device and is longer than ⅕ of the wavelength, and the maximum dimension of a cutout portion designed in the circuit board is defined by 20% or less of the wavelength. Suitably, the maximum dimension is defined by 10% or less of the wavelength.

Figure 7:
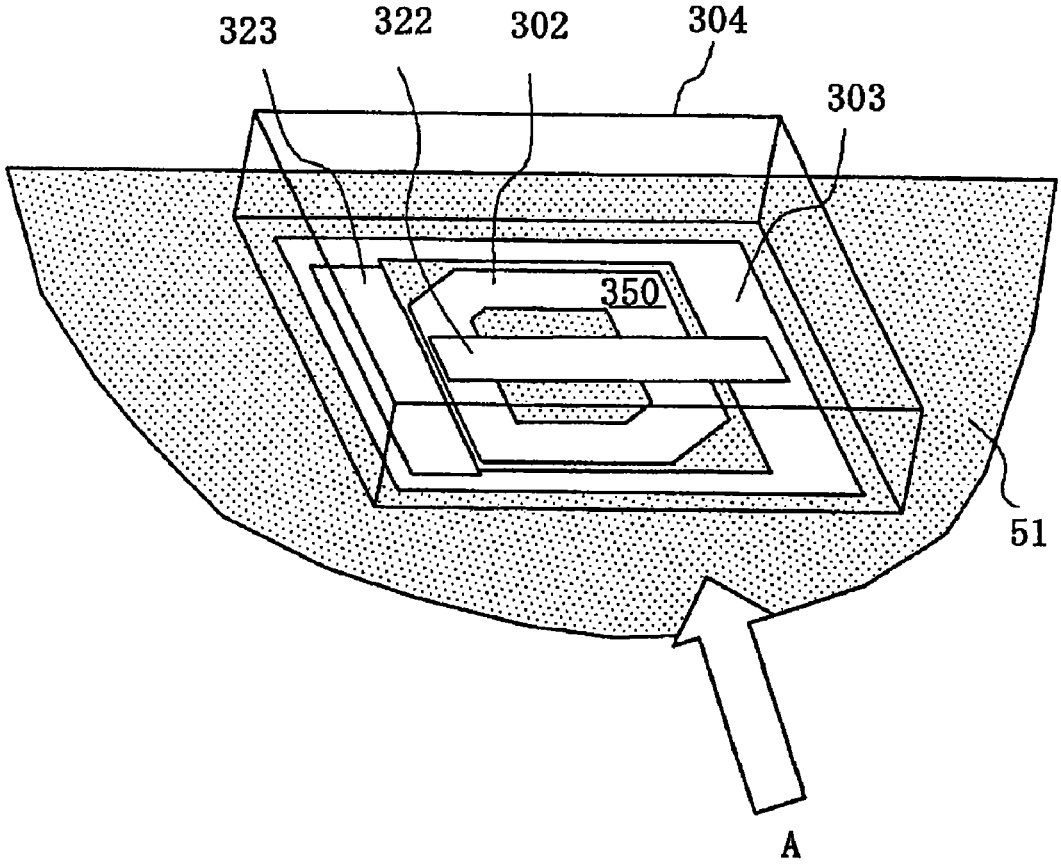
FIG. 7 is a perspective view showing the basic configuration of a feeding structure in an indirect-feeding type of an on-board antenna device for a vehicle in accordance with one embodiment of the present invention.
Figure 8:
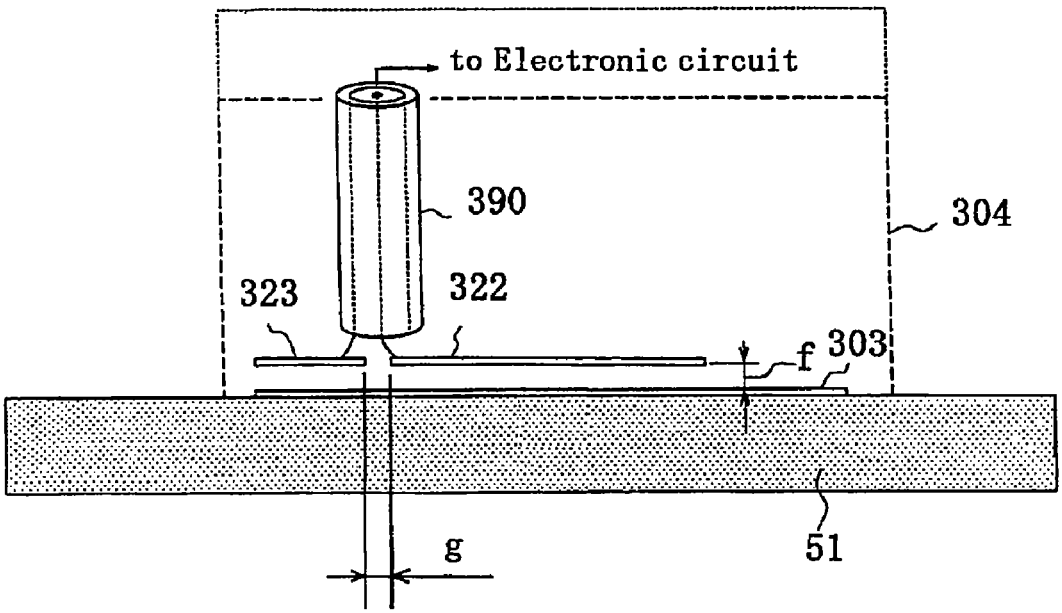
FIG. 8 is a side view of an indirect-feeding type of an on-board antenna device observed from the direction indicated by an arrow A in accordance with one embodiment of the present invention.

FIG. 7 is a perspective view showing the basic configuration of a feeding structure in an indirect-feeding type of an on-board antenna device for a vehicle. FIG. 8 is a side view of an indirect-feeding type of an on-board antenna device observed from the direction indicated by an arrow A of FIG. 7. In FIG. 7, a coplanar antenna 350 may be printed or attached on the surface of a widow glass 51. An electronic circuit unit 304, which has a cavity structure, is assembled to surround the coplanar antenna 350, and only the outline of a housing of the electronic circuit unit is shown in FIG. 8 to be facilitate to understand. The electronic circuit unit 304 comprises: the box-shaped housing including an opening in the side opposed to the coplanar antenna 350; a circuit board (not shown) including pre-amplifier, the circuit board being contained in the housing; a feeding board (not shown) having feeding patterns 322 and 323; a feeder cable 390; and a base plate (not shown).

Two feeding patterns 322 and 323 are integrally formed on the feeding board 307 in the side opposed to the coplanar antenna 350. Each of these feeding patterns is composed of a square-shaped electrode formed by conductive materials.

In an example of FIGS. 7 and 8, the feeding pattern 322 is partially opposed (overlapped) to a radiation element 302 and a ground element 303, and the feeding pattern 323 is partially opposed to the ground element 303, by which the radiation element 302 and the ground element 303 are capacitive-coupled thereto (indirect-feeding). The distance (gap) between the feeding patterns 322 and 323 and the coplanar antenna 350 is set to a predetermined value f as shown in FIG. 8, in the condition of the electronic circuit unit 304 formed on the widow glass 51. The feeding patterns 322 and 323 are vertically arranged through a predetermined gap g in each other. Each of the feeding patterns 322 and 323 may be connected to an amplifier (not shown) through the feeder cable 390. In that case, the manner of connecting the feeding patterns to an electronic circuit board including the amplifier using the coaxial cable for the feeder cable 390 is shown in FIG. 8. Instead of the coaxial cable, a parallel-coupled lines or a micro-strip line may be used for the feeder cable.

As shown in FIGS. 7 and 8, the radiation element 302 and the ground element 303, which constitute the coplanar antenna, may be capacitive-coupled through the feeding patterns 322 and 323, and may be indirect-feeding without using any cable for direct-feeding.

Figure 9:
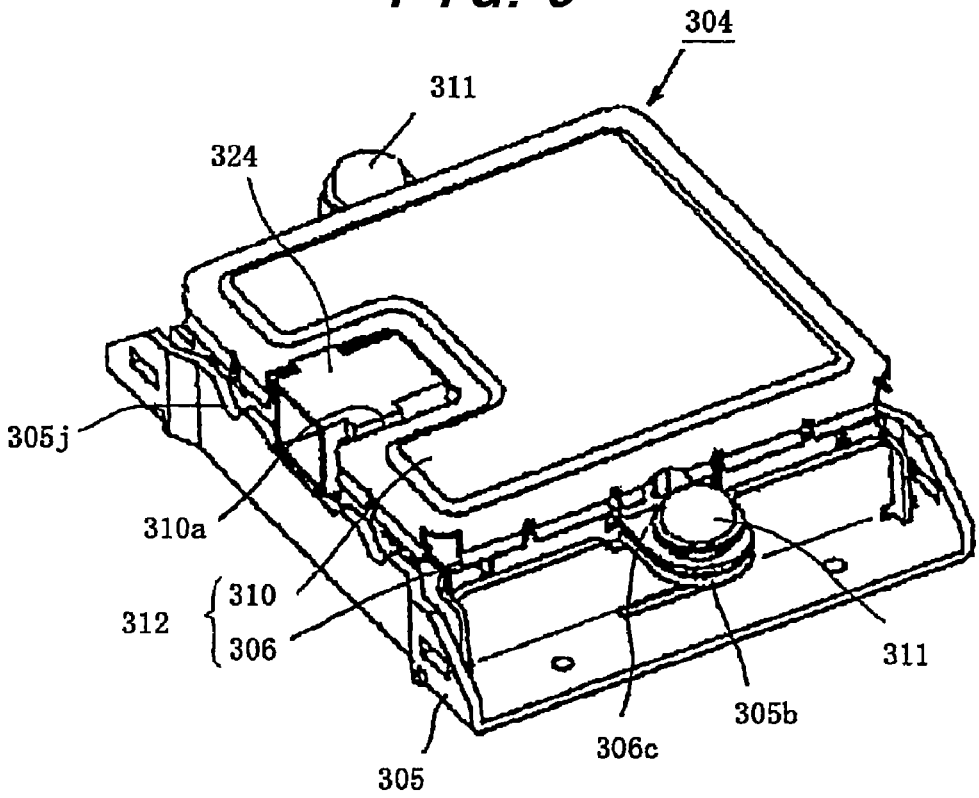
FIG. 9 is a perspective view showing an electronic circuit unit provided for an on-board antenna device in accordance with one embodiment of the present invention.
Figure 10:
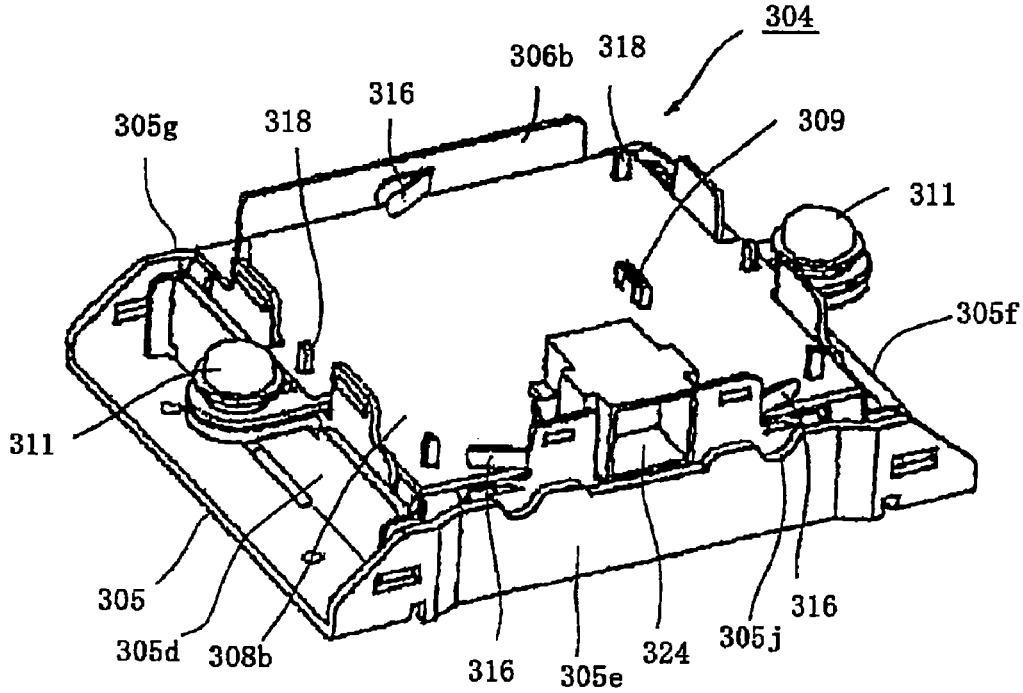
FIG. 10 is a perspective view showing the condition removed a cover of an electronic circuit unit provided for an on-board antenna device in accordance with one embodiment of the present invention.
Figure 11:
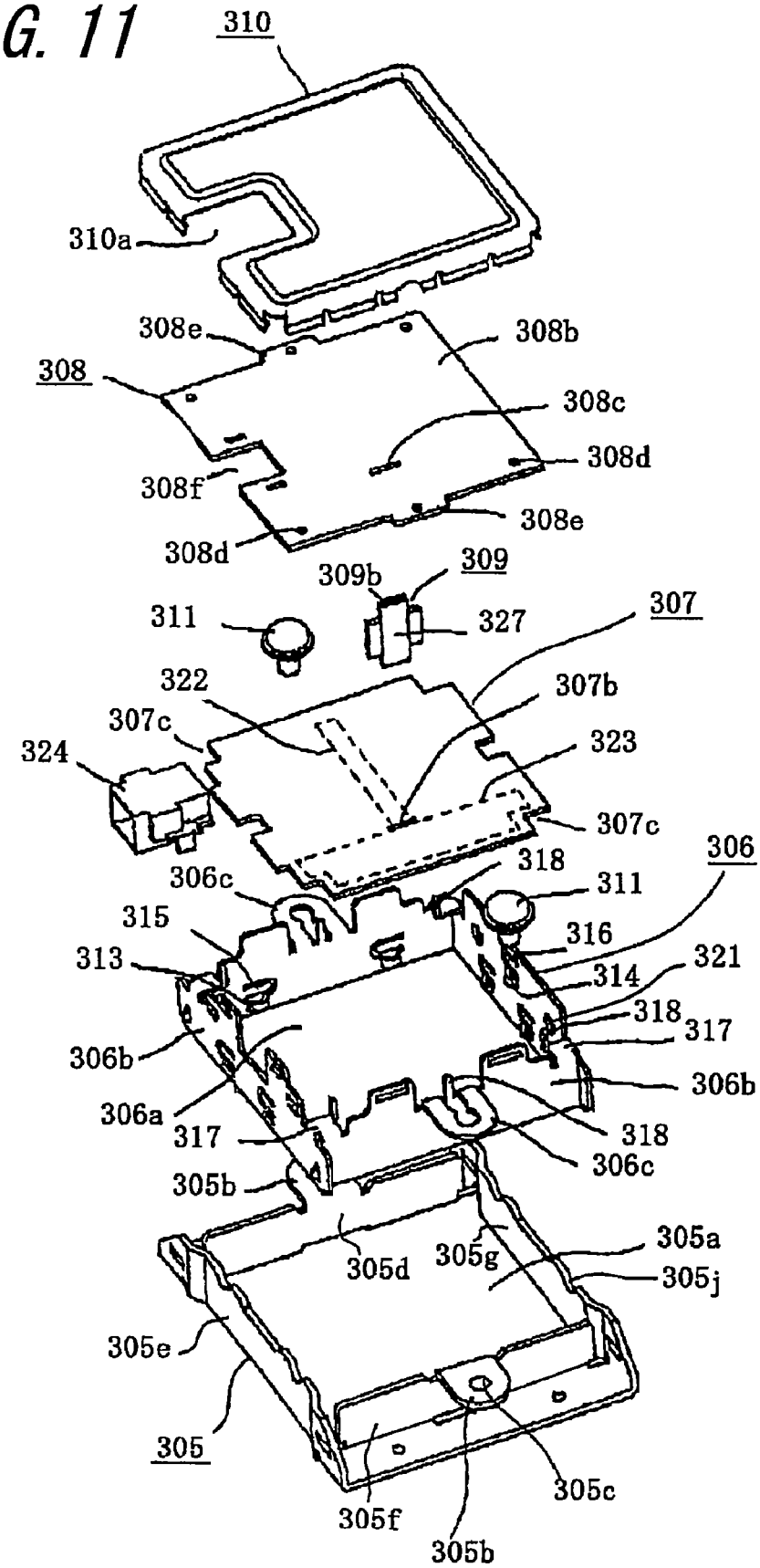
FIG. 11 is an exploded perspective view of an electronic circuit unit in accordance with one embodiment of the present invention.
Figure 12:
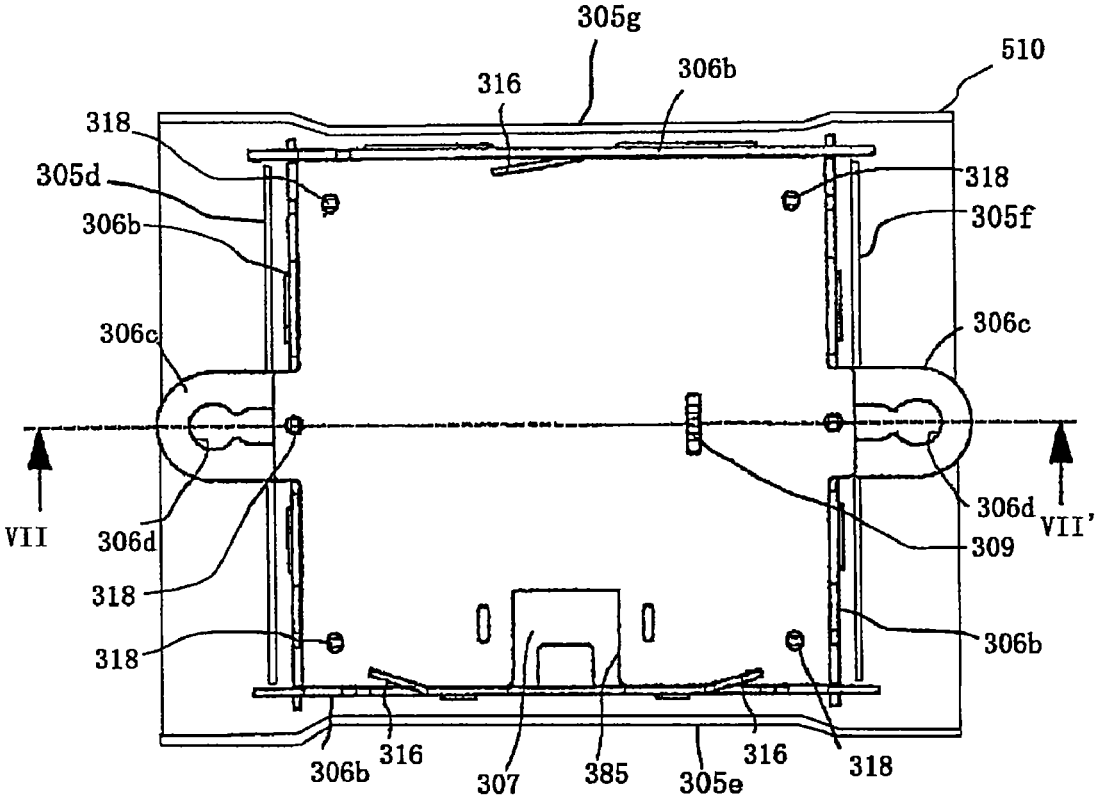
FIG. 12 is a plan view showing an electronic circuit unit omitted a part thereof in accordance with one embodiment of the present invention.
Figure 13:
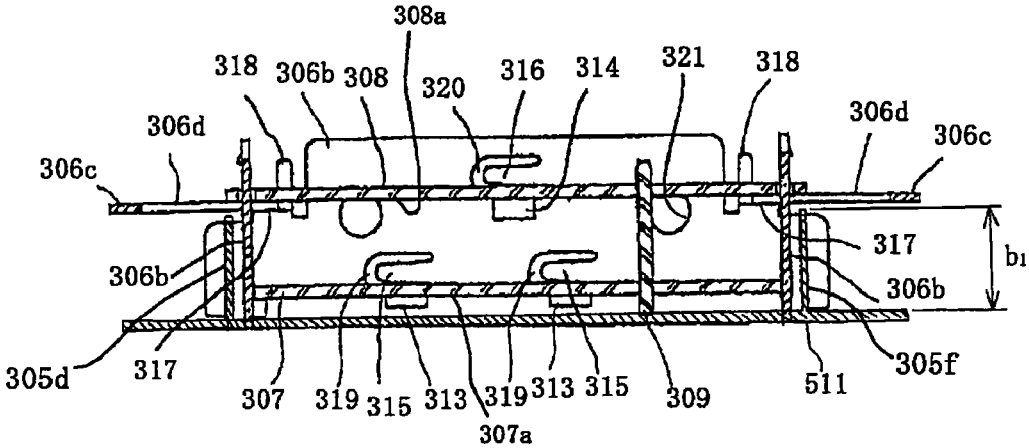
FIG. 13 is a cross-sectional view of the electronic circuit unit along the line VII-VII' in accordance with one embodiment of the present invention.
Figure 14:
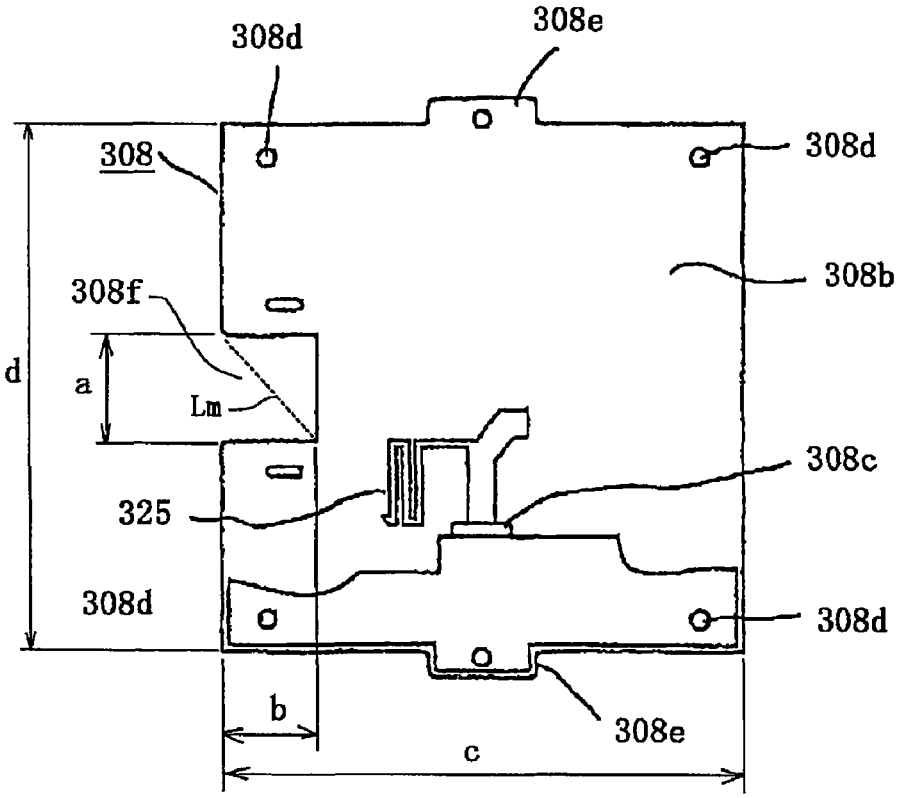
FIG. 14 is a plan view of a circuit board in accordance with one embodiment of the present invention.
Figure 15:
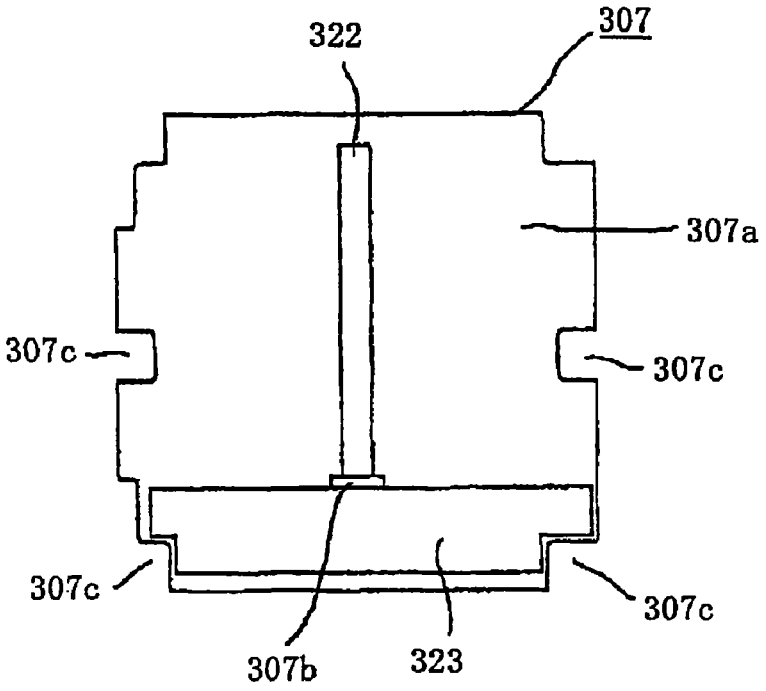
FIG. 15 is a plan view of a feeding board in accordance with one embodiment of the present invention.
Figure 16A:
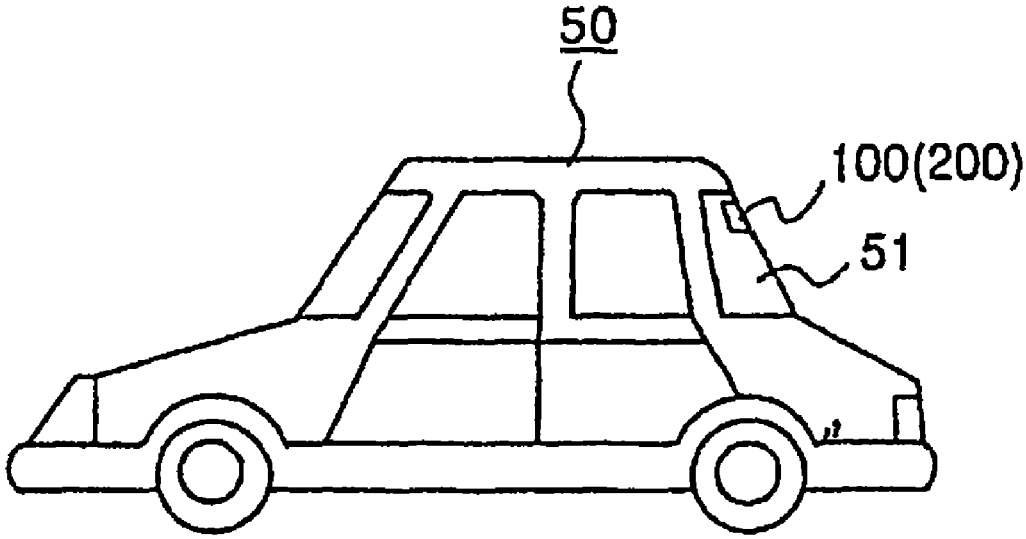
FIG. 16A is a side view of a vehicle.
Figure 16B:
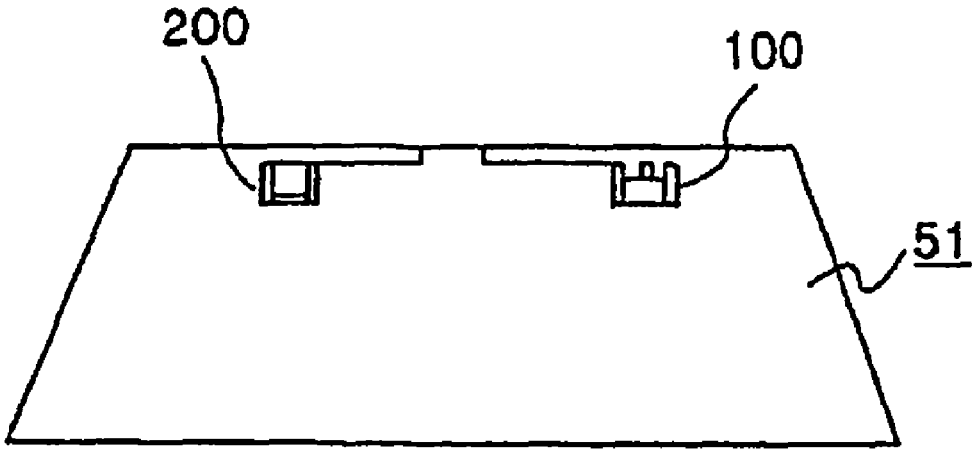
FIG. 16B is a plan view of a rear glass observed from the vehicle interior.

Then, one embodiment of an indirect-feeding type of an on-board antenna device for a vehicle is concretely described. FIG. 9 is a perspective view showing an electronic circuit unit provided for an on-board antenna device in accordance with one embodiment of the present invention. FIG. 10 is a perspective view showing the condition removed a cover of an electronic circuit unit provided for an on-board antenna device in accordance with one embodiment of the present invention. FIG. 11 is an exploded perspective view of an electronic circuit unit in accordance with one embodiment of the present invention. FIG. 12 is a plan view showing an electronic circuit unit omitted a part thereof in accordance with one embodiment of the present invention. FIG. 13 is a cross-sectional view of the electronic circuit unit along the line VII-VII' in accordance with one embodiment of the present invention. FIG. 14 is a plan view of a circuit board in accordance with one embodiment of the present invention. FIG. 15 is a plan view of a feeding board in accordance with one embodiment of the present invention.

As shown in FIGS. 9-15, the electronic circuit unit 304 comprises: a base plate 305 including a square-shaped opening 305*a;* a frame 306 including a square-shaped opening 306*a* with a substantial identical shape with respect to the opening 305*a;* a feeding board 307 and a circuit board 308 which are arranged in mutually parallel within the opening 306*a* of the frame 306; a small connection board 309 arranged between the feeding board 307 and the circuit board 308 in a vertical direction to the feeding board and the circuit board; a cover for covering the frame 306 to wrap over the opening 306*a;* and a pair of fixing screws 311 for fixing the frame 306 to the base plate 305, the frame 306 being detachable from the base plate 305 by detaching the fixing screws. A housing 312 of the electronic circuit unit 304 is composed of the frame 304 and the cover 310 for containing the feeding board 307, the circuit board 308, the small connection board 309 and so on.

As shown in FIG. 11, first supporting portions 313 are formed on the frame 306 to define the height position of the feeding board 307, and the surrounding edge of the feeding board 307 is tightly fixed by the first supporting portions 313 and first tongues 315 in the direction of the thickness of the feeding board 307. As the first supporting portions 313 and the first tongues 315 are bent in the direction of the inside of the electronic circuit unit 304, through-holes 319 are designed into the frame 306. Second supporting portions 314 are formed on the frame 306 to define the height position of the circuit board 308, and the surrounding edge of the circuit board 308 is tightly fixed by the second supporting portions 314 and second tongues 316 in the direction of the thickness of the circuit board 308. As the second supporting portions 314 and the second tongues 316 of sidewalls 306*b* are bent in the direction of the inside of the electronic circuit unit 304, through-holes 320 are designed into the frame 306. The height of the circuit board 308 is defined by receiving-portions 317 formed in the four corners of the opening 306*a* as well as the second supporting portions 314, and each of the receiving-portions 317 is a receiving side for supporting the four corners of the circuit board 308. In addition, a plurality of apertures 321 which function as water-pulling out holes are designed into the frame 306 to pass through water from internal space to external space thereof, and the apertures 321 may be designed in the lower side of sidewalls 306*b*, where the lower side means the downward region of the on-board antenna device formed on the widow glass 51.

It is further described with regard to the frame 306. The frame 306 is substantially composed of four sidewalls 306*b* for containing the square-shaped opening 306*a*, and of a pair of outwardly protruded portions 306*c*, which are protruded from each of sidewalls 306*b* mutually opposed. Each of the outwardly protruded portions 306*c* are formed in the location corresponding to each of outwardly protruded portions 305*b* of the base plate 305, and through-holes 306*d* are designed into the outwardly protruded portions 306*c* to pass through fixing screws 311, respectively. The first supporting portions 313 and the second supporting portions 314 are bent from the sidewalls 306*b* toward the inside of the frame 306. The first tongues 315 and the second tongues 316 are bent from the sidewalls 306*b* toward the inside of the frame 306 at the neighboring portion of the supporting portions 313 and 314. The receiving portions 317 are successively contacted to the neighboring sidewalls of the frame 306 in four corners of the opening 306*a*. Guiding portions 318 are designed into the frame 306, the guiding portions 318 standing from the root portions of outwardly protruded portions 306*c* and from the top of receiving portions 317, respectively.

The feeding board 307 supported in the frame 406 is closely arranged to the widow glass 51, and one surface (the opposite surface to the glass 51) of the feeding board 307 is a pattern forming surface 307*a* having the feeding pattern 322 and the feeding pattern 323. The pattern forming surface 307*a* is mainly arranged in the opposing location opposed to the radiation element 302. A connection hole 307*b* is designed between the feeding pattern 322 and the feeding pattern 323 of the feeding board 307 to pass through the one end of the small connection board 309.

The circuit board 308 is supported in the frame 306 to be opposed to the feeding board 307 keeping a predetermined distance. One surface (the opposite surface to the feeding board 307) of the circuit board 308 is an electromagnetic wave reflecting surface 308*a* provided with a conductive layer in substantial entire area thereof. The other surface of the circuit board 308 is a component mounting surface 308*b* provided with a pre-amplifier 325 as a part of components. As shown in FIG. 11, a connection hole 308*c* is designed into the circuit board 308 to pass through the other end of the small connection board 309. A plurality of aligning holes 308*d* are designed into the surrounding edge of the circuit board 308 to pass through the guiding portions 318 of the frame 306, and protrusions 308*e* are designed into the circuit board 308 at the location corresponding to the root portion of the outwardly protruded portions 306*c* of the frame 306, respectively. Moreover, a cutout portion 308*f* of relatively large depression-shape is provided for the circuit board 308 at the location corresponding to the assembling position of a connector 324.

The small connection board 309 is arranged between the feeding board 307 and the circuit board 308 in a vertical direction of these boards to pass through the each end of these boards to each of the connection holes 307*b* and 308*c*, respectively. The transmission routes (i.e. one or more lines for electrically connecting the feeding board 307 to the circuit board 308, which are not shown in FIGS. 9-15), for example micro-strip lines, are formed on the one surface of the small connection board 309. Ground lines 327 are formed on the other surface 327 of the small connection board 309. Each one end of the micro-strip lines toward the feeding board 307 are soldered into the feeding pattern 322, and each one end of the ground lines 327 toward the feeding board 307 are soldered into the feeding pattern 323, and each one of the other end of the ground lines 327 toward the circuit board 308 are soldered into a terminal of the pre-amplifier 325, respectively. As a result, the feeding board 307 and the circuit board 308 are electrically connected.

Thus, after the cover 310 has been covered on the frame 306 to wrap over the component mounting surface 308*b* of the circuit board 308, the frame 306 is arranged into the opening 305*a* of the base plate 305 fixed to the widow glass 51 in the vehicle interior. In that case, the outwardly protruded portions 306*c* are overlapped to the outwardly protruded portions 305*b*, and the through-holes 306*d* of the frame 306 are fixed to the female screws 305*c* of the base plate 305 by clamping with the fixing screws 311, respectively. In this manner, the electronic circuit unit 304 is formed on the widow glass 51 by assembling the frame 306 to the base plate 305. Thereby, the feeding pattern 322 is closely opposed to the radiation element 302 and the ground element 303, and the feeding pattern 323 is closely opposed to the ground element 303. Therefore, connecting a coaxial cable from a receiver (not shown) to the connector 324, the feeding pattern 322 is electro-magnetically coupled to the radiation element 302 and the ground element 303, and the feeding pattern 323 is electro-magnetically coupled to the ground element 303, whereby the indirect-feeding for receiving the broadcast wave may be implemented.

The cutout portion 308*f* of the circuit board 308, which is a feature of the present invention, is shown in FIG. 14. As described in FIGS. 1A and 1B, the method for defining the cutout portion of the circuit board may be applied to the indirect-feeding type of the on-board antenna device. Each of the significant dimensions (a, b, c and d) described in FIGS. 1A and 1B is similarly shown in FIG. 14. In that case, each of the dimensions (a, b, c and d) need not be same as the dimensions shown in FIGS. 2A-2C, but the same numerals are fixed to similar components or elements with respect to FIGS. 2A-2C for a convenience of the description.

That is, the side c and length d of a circuit board is shorter than a wavelength of a receiving frequency band of an on-board antenna device and is longer than ⅕ of the wavelength, and the maximum dimension of a cutout portion designed into the circuit board 426*b* is defined by 20% or less of the wavelength.

According to an embodiment of the present invention, the connector for transmission line connection may be arranged into the cutout portion of the circuit board provided for the on-board antenna device without making the on-board antenna device large. Moreover, the indirect feeding type of the on-board antenna device with feeding pattern 322 electro-magnetically coupling to the radiation element 302 may be implemented without decreasing the antenna performance. In addition, the soldering process of the output cable may be omitted, whereby manufacturing cost of the on-board antenna device may be reduced.

While the present invention has been described and illustrated with reference to specific exemplary embodiments, it should be understood that many modifications and substitutions could be made without departing from the spirit and scope of the invention. For example, while it is described in the embodiments that the cutout portion of the circuit board has a substantial square-shape, the cutout portion may include any shape based on the method for defining the cutout portion in accordance with the present invention. Alternatively, while it is described in the embodiments that the receiving frequency band of the on-board antenna device is for a satellite, the receiving frequency band is not limited thereto. In addition, while it is described in the embodiments that the location on which the on-board antenna device is formed is a rear glass, the on-board antenna device may be formed on a window shield or a side-widow glass for a vehicle. Accordingly, the present invention is not to be considered as limited by the foregoing description but is only limited by the scope of the appended claims.

According to the present invention, it is useful for an on-board antenna device for a vehicle, since the on-board antenna device with more high quality and more high-stability may be provided with manufacturing cost reduced, because the connector for transmission line connection may be arranged into the cutout portion of the circuit board provided for the on-board antenna device without making the on-board antenna device large and the soldering process of the output cable may be omitted.

The invention claimed is:

1. An on-board antenna device, comprising:

a radiation element formed on an inner-surface of a widow glass for a vehicle;

a base plate fixed on the inner-surface of the widow glass so as to surround the radiation element;

a circuit board having a conductive layer in one surface thereof which is opposed to the radiation element and a component mounting surface electrically connected to the radiation element in the other surface thereof; and a housing assembled onto the base plate to contain the circuit board;

wherein the circuit board has a cutout portion to incorporate a connector for a transmission line connection.

2. An on-board antenna device, comprising:

a radiation element formed on an inner-surface of a widow glass for a vehicle;

a base plate having an opening, the base plate being fixed on the inner-surface of the widow glass so as to surround the radiation element;

a feeding board arranged a feeding pattern on one surface thereof, the feeding pattern being opposed with a predetermined distance to the radiation element;

a circuit board including a conductive layer formed across the substantial entire area of one surface thereof which is opposed to the feeding board and a pre-amplifier mounted on the other surface thereof;

a small connection board arranged between the feeding board and the circuit board in a vertical direction to the feeding board and the circuit board; and a housing assembled onto the base plate to contain the feeding board, the circuit board and the small connection board in a space surrounded thereby;

wherein the on-board antenna device is indirect-feed by electro-magnetically coupling the feeding pattern to the radiation element and the circuit board has a cutout portion to incorporate a connector for a transmission line connection.

3. The on-board antenna device according to the claim 1 or 2, wherein the outward form of the circuit board is shorter than a wavelength of a receiving frequency band thereof and is longer than ⅕ of the wavelength.

4. The on-board antenna device according to the claim 1 or 2 wherein the maximum dimension of the cutout portion is shorter than 20% of a wavelength of a receiving frequency band thereof.

* * * * *